US009351523B2

(12) United States Patent
Kitagawa

(10) Patent No.: US 9,351,523 B2
(45) Date of Patent: May 31, 2016

(54) SKIRT-TYPE CONTROLLING UNDERGARMENT

(75) Inventor: Yuka Kitagawa, Kyoto (JP)

(73) Assignee: WACOAL CORP, Kyoto-shi, Kyoto (JP)

( * ) Notice: Subject to any disclaimer, the term of this patent is extended or adjusted under 35 U.S.C. 154(b) by 117 days.

(21) Appl. No.: 13/881,465

(22) PCT Filed: Oct. 29, 2010

(86) PCT No.: PCT/JP2010/069345

§ 371 (c)(1),
(2), (4) Date: May 10, 2013

(87) PCT Pub. No.: WO2012/056572

PCT Pub. Date: May 3, 2012

(65) Prior Publication Data

US 2013/0225046 A1 Aug. 29, 2013

(51) Int. Cl.

| | |
|---|---|
| ***A41C 1/00*** | (2006.01) |
| *A41B 9/08* | (2006.01) |
| *A41B 9/00* | (2006.01) |
| *A41D 1/14* | (2006.01) |

(52) U.S. Cl.

CPC ..... *A41C 1/003* (2013.01); *A41B 9/002* (2013.01); *A41B 9/08* (2013.01); *A41D 1/14* (2013.01)

(58) Field of Classification Search

CPC ..... A41C 1/00; A41C 1/003; A41C 1/006; A41C 1/02; A41D 1/14; A41B 2400/38; A41B 9/002

USPC ..... 450/100–105, 153, 132, 148, 94, 97, 450/125–126, 128; 2/406, 212, 211

See application file for complete search history.

(56) References Cited

U.S. PATENT DOCUMENTS

| | | | | | |
|---|---|---|---|---|---|
| 1,201,860 | A | * | 10/1916 | Nelke | A41B 9/08 2/113 |
| 1,636,516 | A | * | 7/1927 | Kops | 450/102 |
| 1,813,408 | A | * | 7/1931 | Kops | 450/102 |
| 2,078,184 | A | * | 4/1937 | Russell | 602/67 |

(Continued)

FOREIGN PATENT DOCUMENTS

| | | |
|---|---|---|
| CN | 1207882 A | 2/1999 |
| CN | 1973713 A | 6/2007 |

(Continued)

OTHER PUBLICATIONS

Notice of Reasons for Rejection, counterpart Japanese Application No. P2012-540627 mailed May 13, 2014.

(Continued)

*Primary Examiner* — Andrew W Collins
*Assistant Examiner* — Brieanna Szafran
(74) *Attorney, Agent, or Firm* — Jeremy Jay

(57) ABSTRACT

A skirt liner 1 according to an embodiment of the present invention is provided with a skirt-type main body 10, and an abdomen and crotch tightening part 20 joined at one end side thereof to a region around a front waist part of the main body 10, extending from the one end side so as to cover an abdominal part and a crotch part, and joined at the other end side thereof to a back lower center of the main body 10, in which the portion of the abdomen and crotch tightening part 20 other than the one end side and the other end side is unjoined to the main body 10.

2 Claims, 12 Drawing Sheets

(56) References Cited

U.S. PATENT DOCUMENTS

| | | | | | |
|---|---|---|---|---|---|
| 2,190,030 | A * | 2/1940 | Kops | 450/116 | |
| 2,503,636 | A * | 4/1950 | Rockwell | 450/103 | |
| 2,519,866 | A * | 8/1950 | Wellstatter | A41B 9/08 | 2/212 |
| 2,541,698 | A * | 2/1951 | Gulisano | 2/212 | |
| 2,592,665 | A * | 4/1952 | Deutsch | A41D 1/06 | 2/212 |
| 2,597,587 | A * | 5/1952 | Lustgarten | A41B 9/04 | 2/408 |
| 2,696,003 | A * | 12/1954 | Herbener | 450/104 | |
| 2,896,633 | A * | 7/1959 | McKee | 450/102 | |
| 3,144,870 | A * | 8/1964 | Grishman | 450/103 | |
| 3,169,531 | A * | 2/1965 | Grishman | 450/95 | |
| 3,169,533 | A * | 2/1965 | Grishman | 450/104 | |
| 3,169,534 | A * | 2/1965 | Grishman | 450/104 | |
| 3,176,693 | A * | 4/1965 | Grishman | 450/104 | |
| 3,192,930 | A * | 7/1965 | Grishman | 450/95 | |
| 7,546,751 | B2 * | 6/2009 | Lutz | A41B 9/00 | 66/171 |
| 2002/0133865 | A1 * | 9/2002 | Neman | 2/170 | |

FOREIGN PATENT DOCUMENTS

| | | | |
|---|---|---|---|
| JP | S46-014206 | B1 | 4/1971 |
| JP | S50-011728 | U | 6/1973 |
| JP | H4-118403 | U | 10/1992 |
| JP | H5-037904 | U | 5/1993 |
| JP | 3023110 | U9 | 4/1996 |
| JP | H9-013201 | A | 1/1997 |
| JP | 2000-096309 | A | 4/2000 |
| JP | 2000-178803 | A | 6/2000 |
| JP | 3126486 | U | 10/2006 |
| JP | 2007-077566 | A | 3/2007 |

OTHER PUBLICATIONS

International Preliminary Report on Patentability, International Application No. PCT/JP2010/069345, mailed May 23, 2013.

International Search Report, International Application No. PCT/JP2010/069345, mailed Nov. 22, 2010.

Office Action, Chinese Application No. 201080069912.4, dated Mar. 17, 2014.

* cited by examiner (a)

(b)

(a)

(b)

(c)

(a)

(b)

(c)

SKIRT-TYPE CONTROLLING UNDERGARMENT

TECHNICAL FIELD

The present invention relates to a skirt-type controlling undergarment.

BACKGROUND ART

Girdles are commonly known as undergarments for controlling the abdominal region, the gluteal region, and so on, and there are also skirt-type controlling undergarments designed like skirt liners and petticoats, as well as the girdles. The skirt-type controlling undergarments of this kind are disclosed in Patent Literatures 1 to 3. Patent Literature 1 discloses a petticoat with a girdle function in which a crotch piece is sewn to a crotch part of a petticoat main body and in which an elastic piece extending from the crotch piece is sewn to an abdominal part of the petticoat main body. Patent Literature 2 discloses a girdle with shorts in which the shorts are sewn to an inner surface of a binder-type girdle main body. Patent Literature 3 discloses underpants with a corset in which corset and gore parts are sewn to an interior of a tubular portion for a binder.

CITATION LIST

Patent Literatures

Patent Literature 1: Japanese Utility Model Application Laid-open No. H05-37904

Patent Literature 2: Japanese Utility Model Application Laid-open No. H04-118403

Patent Literature 3: Japanese Patent Application Laid-open No. H09-13201

SUMMARY OF INVENTION

Technical Problem

In the meantime, it seems that young women tend not to use controlling undergarments because of a question of appearance. For example, in the cases of the skirt-type undergarments disclosed in Patent Literatures 1 to 3, the sewn part of the tightening part or the crotch part (crotch piece) appears on a skirt main body and therefore the existence of the controlling undergarment is quite obvious, which makes young women reluctant to wear the controlling undergarment of this kind.

However, there are quite a few women, even the young, worrying about an abdominal bulge and/or sagging buttocks, leading to desires for a good-looking controlling undergarment.

It is therefore an object of the present invention to provide a good-looking skirt-type controlling undergarment for young women.

Solution to Problem

A skirt-type controlling undergarment of the present invention comprises a skirt-type main body and an abdomen and crotch tightening part. The abdomen and crotch tightening part is joined at one end side thereof to a region around a front waist part of the main body, extends from the one end side so as to cover an abdominal part and a crotch part, and is joined at the other end side thereof to a back lower center of the main body. The portion of the abdomen and crotch tightening part other than the one end side and the other end side is unjoined to the main body.

Since the portion of the abdomen and crotch tightening part other than the one end side and the other end side is unjoined to the main body in the skirt-type controlling undergarment, the existence of the abdomen and crotch tightening part does not appear on the main body. Therefore, the skirt-type controlling undergarment of the present invention is a good-looking skirt-type undergarment, which would make young women feel unreluctant to wear.

In this way, the skirt-type controlling undergarment is the good-looking skirt-type undergarment and has an excellent operational effect in terms of controlling the abdominal and gluteal regions, as described below. Namely, the abdomen and crotch tightening part can control an abdominal bulge. Furthermore, the abdomen and crotch tightening part can keep a main back part of the main body fitting closely with the buttocks so as to control the sagging of the buttocks. In addition, the abdomen and crotch tightening part can prevent a hem of the skirt main body from riding up or slipping up.

Preferably, the other end side of the abdomen and crotch tightening part is joined in a gathering and narrowing manner toward a body center.

This configuration allows the crotch part of the abdomen and crotch tightening part to be three-dimensionally shaped and to fit tightly with the wearer's crotch region. For this reason, the other end side of the abdomen and crotch tightening part is securely forced into the hollow in the lower part of the intergluteal cleft and the body center part between the gluteal folds, whereby the main back part of the main body can fit more closely with the lower part of the gluteal region. As a result, the undergarment is able to better control the sagging of the buttocks.

Another skirt-type controlling undergarment of the present invention is one comprising: a skirt-type main body; an abdomen and crotch tightening part which is joined at one end side thereof to a region around a front waist part of the main body, which extends from the one end side so as to cover an abdominal part and a crotch part, and which is joined at the other end side thereof to a back side of the main body; and an abdomen tightening part which extends from a center of the front waist part of the main body toward left and right lower sides while covering the abdominal part, wherein the portion of the abdomen and crotch tightening part other than the one end side and the other end side is unjoined to the main body.

In this skirt-type controlling undergarment as well, since the portion of the abdomen and crotch tightening part other than the one end side and the other end side is unjoined to the main body, the existence of the abdomen and crotch tightening part does not appear on the main part, as described above. Therefore, the skirt-type controlling undergarment of the present invention is a good-looking skirt-type undergarment, which would make young women feel unreluctant to wear.

In this way, the skirt-type controlling undergarment is also the good-looking skirt-type undergarment and has an excellent operational effect in terms of controlling the abdominal and gluteal regions, as described below. Namely, as described above, the abdomen and crotch tightening part can control the abdominal bulge and the sagging of the buttocks. Furthermore, the abdomen tightening part can also control the abdominal bulge.

Incidentally, when the abdominal region is pressed by the conventional horizontally-extending abdomen tightening part, the abdominal flesh is pushed up to above the abdomen tightening part, so as to form a bump between covered and uncovered regions. In the skirt-type controlling undergarment of this invention, however, the abdomen tightening part applies oblique downward pressure from the front center to the left and right sides, whereby a downward force acts on the abdominal flesh. Therefore, the abdominal flesh is not pushed up to above the abdomen tightening part, whereby the bump is unlikely to be formed between the covered and uncovered regions.

Furthermore, with this skirt-type controlling undergarment, the abdomen and crotch tightening part can smooth the abdominal flesh moved down by the abdomen tightening part.

Preferably, the aforementioned other end side of the abdomen and crotch tightening part is joined to a back lower center of the main body. In this configuration, since the abdomen and crotch tightening part is sewn to the main back part at a position near a hem of the main body, as described above, the abdomen and crotch tightening part can make the main back part of the main body fit closely with the gluteal region, so as to better control the sagging of the buttocks. In addition, it can prevent the hem of the skirt main body from riding up or slipping up.

Preferably, the other end side of the abdomen and crotch tightening part is joined in a gathering and narrowing manner toward a body center. This configuration allows the crotch part of the abdomen and crotch tightening part to be three-dimensionally shaped and to fit tightly with the wearer's crotch region, as described above. For this reason, the other end side of the abdomen and crotch tightening part is securely forced into the hollow in the lower part of the intergluteal cleft and the body center part between the gluteal folds, whereby the main back part of the main body can fit more closely with the lower part of the gluteal region, so as to be able to better control the sagging of the buttocks.

Preferably, a central edge of the abdomen tightening part is joined to the center of the front waist part of the main body, left and right side edges of the abdomen tightening part are joined to sides of the main body, and the portion of the abdomen tightening part other than the central edge and the left and right side edges is unjoined to the main body.

In this configuration, since the portion of the abdomen tightening part except for the central edge and the left and right side edges is unjoined to the main body, the existence of the abdomen tightening part does not appear on the main body. Therefore, the skirt-type controlling undergarment of the present invention is a good-looking skirt-type undergarment, which would make young women feel unreluctant to wear.

Preferably, the abdomen tightening part is joined to the main body. This configuration can increase a controlling force on the abdominal region by the abdomen tightening part.

Preferably, the abdomen tightening part is formed by knitting along with the main body. This configuration can increase the controlling force on the abdominal region by the abdomen tightening part and offer a simple appearance. In addition, it can facilitate manufacture.

Advantageous Effect of Invention

The present invention has successfully realized the good-looking skirt-type controlling undergarments for young women.

DESCRIPTION OF EMBODIMENTS

The preferred embodiments of the present invention will be described below in detail with reference to the drawings. Identical or equivalent portions will be denoted by the same reference signs throughout the drawings.

Figure 1:
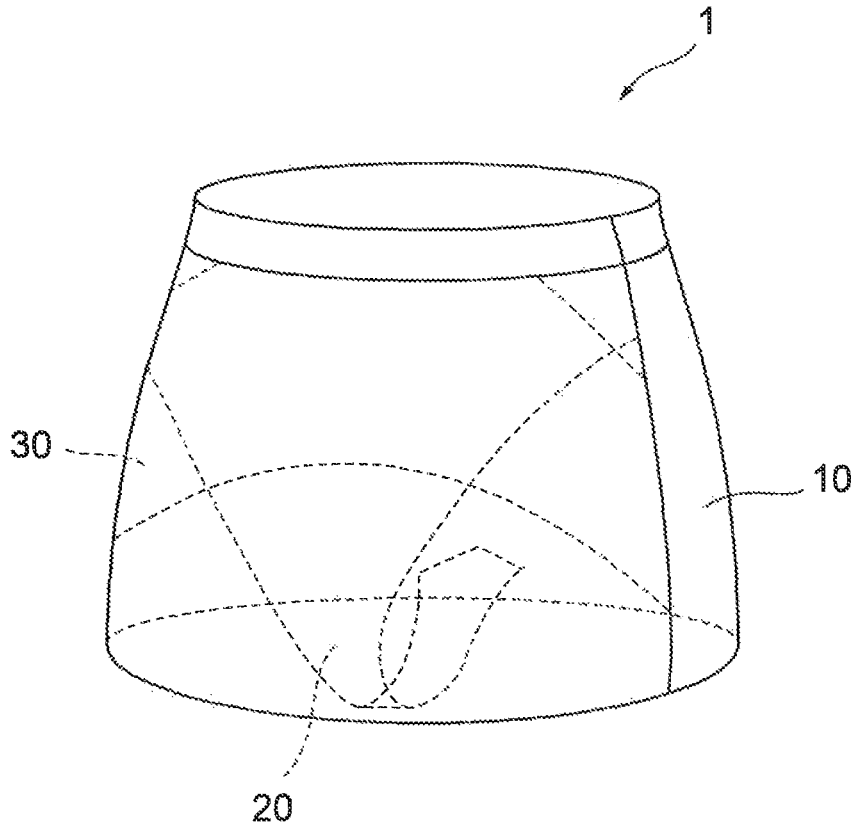
FIG. 1 is a perspective view showing a skirt liner according to an embodiment of the present invention.
Figure 2:
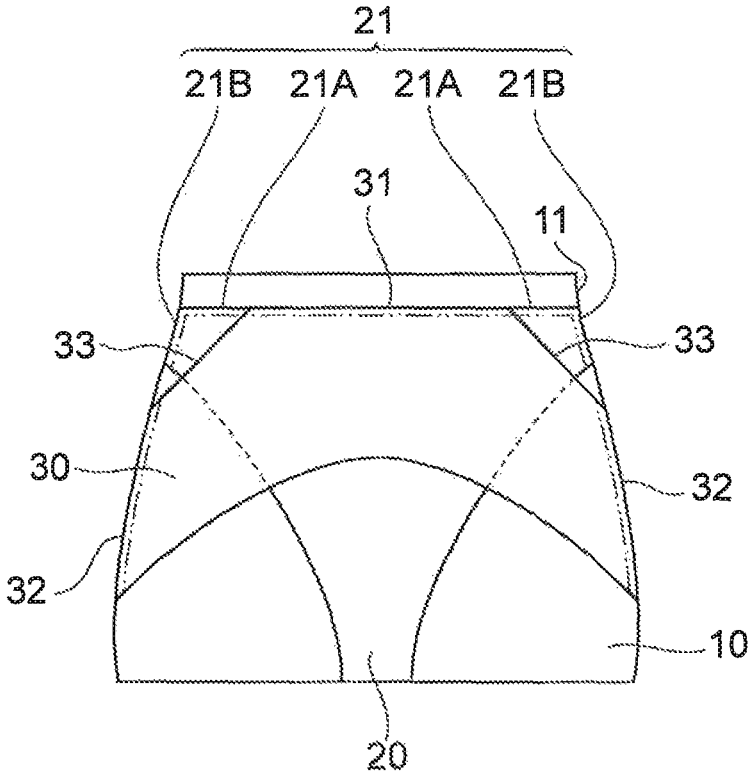
FIG. 2 is a front view of a wrong side of the skirt liner according to the embodiment of the present invention which is viewed from the front.
Figure 3:
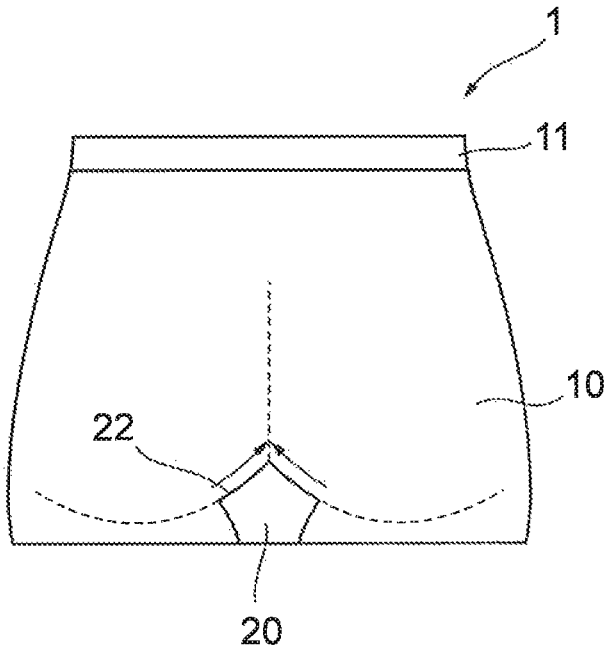
FIG. 3 is a back view of the wrong side of the skirt liner according to the embodiment of the present invention which is viewed from the back.
Figure 4:
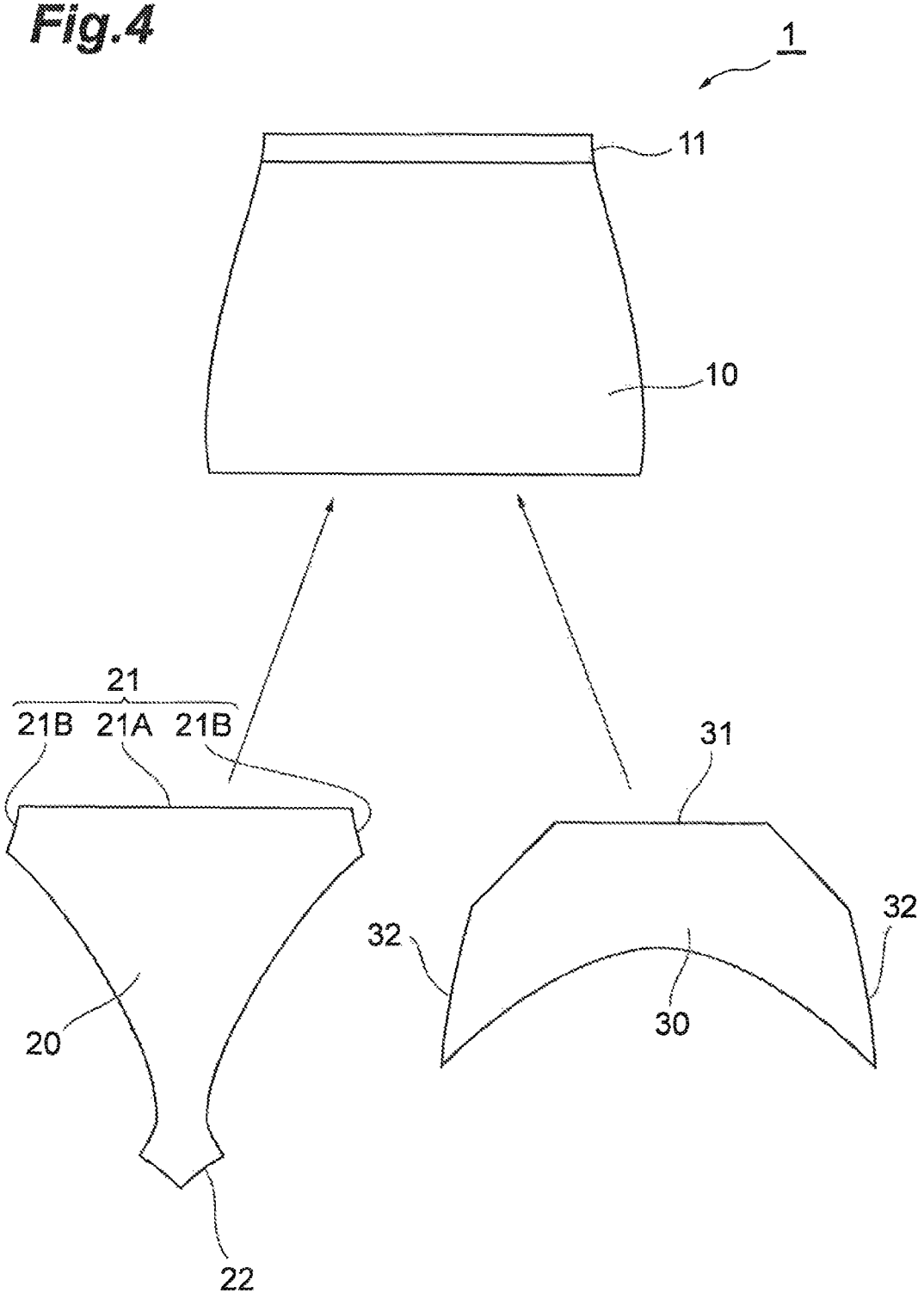
FIG. 4 is an exploded view showing a disassembled state of the skirt liner according to the embodiment of the present invention.

FIG. 1 is a perspective view showing a skirt liner according to an embodiment of the present invention, FIG. 2 a front view of a wrong side (skin side) of the skirt liner according to the embodiment of the present invention which is viewed from the front, and FIG. 3 a back view of the wrong side of the skirt liner according to the embodiment of the present invention which is viewed from the back. FIG. 4 is an exploded view showing a disassembled state of the skirt liner according to the embodiment of the present invention. The skirt liner shown in FIGS. 1 to 4 is provided with a main body 10, an abdomen and crotch tightening part 20, and an abdomen tightening part 30.

The main body 10 is a skirt-type undergarment to cover the wearer's abdominal and gluteal regions, is comprised of an elasticized fabric, and is formed so as to fit closely with the wearer's abdominal and gluteal regions when the undergarment is worn. For example, in the main body 10 a fabric of a main front part (e.g., two-way material) and a fabric of a main back part (e.g., two-way material) are sewn together on the left and right sides. In the main body 10, an elasticized material, e.g. an elastic yarn-mixed tape, is sewn as a waist part 11 to ensure a good fit with the waist when the undergarment is worn.

In the present embodiment, the waist part 11 is made by sewing two pieces on the left and right sides as the main body 10 is, but the present invention does not have to be limited to this configuration. For example, the two ends of the waist part 11 may be sewn to each other at a portion except for the left and right sides, e.g., at the back center, without seams on the left and right sides.

The present embodiment is described with an example wherein the main body 10 is composed of the main front part and the main back part, but the present invention does not have to be limited to this configuration. Another conceivable method of forming the main body 10 is, for example, such that the two ends of a single fabric are sewn (or joined together) at the back center or at the front center to form the body (main body 10). Still another conceivable method is to join fabrics of left and right parts together at the front center and at the back center to form the body (main body 10).

The present embodiment shows the example wherein joint lines are formed to construct the body in the main body; however, there are some of knits, such as a tubular knit fabric, the body of which is completed at the stage of knitting, and it is considered that if the main body 10 is made of such a knit fabric, there is no joint line made in the body; such a knit may be used as a knit fabric for the main body 10. The abdomen and crotch tightening part 20 and the abdomen tightening part 30 are provided on the wrong side of the main body 10.

The abdomen and crotch tightening part 20 has a tightening force and is considered to be made, for example, of a highly elasticized fabric such as a power net fabric. The abdomen and crotch tightening part 20 extends downward along the wearer's abdominal region from the front side of the waist part 11 of the main body 10 and further extends along the wearer's crotch region toward the back side.

One end (one end side) 21 of this abdomen and crotch tightening part 20 consists of an upper side 21A and, oblique sides 21B adjacent respectively to the left and right ends of the upper side 21A, and is sewn to a front peripheral region of the waist part 11 of the main body 10. More specifically, the upper side 21A is sewn to the front side of the waist part 11 and the oblique sides 21B are sewn respectively to the left and right side portions adjacent to the waist part 11. In the present embodiment, the front portion of the waist part 11 (portion to which the upper side 21A is sewn) and the side portions of the main body 10 adjacent to the foregoing front portion (portions to which the oblique sides 21B are sewn) correspond to the "region around the front waist part."

The present embodiment shows the example wherein the crotch tightening part 20 is also joined to the side portions of the waist part 11, but the present invention does not have to be limited to this configuration. For example, the crotch tightening part 20 may be sewn only to the front portion of the waist part 11, depending upon specifications of products. Instead of the configuration wherein the one end 21 of the crotch tightening part 20 is attached throughout the entire width of the front portion of the waist part 11, it is also possible to adopt a mode wherein the crotch tightening part 20 is attached only to a part of the front portion of the waist part 11.

On the other hand, the other end (other end side) 22 of the abdomen and crotch tightening part 20 is sewn to the back lower center of the main body 10. In the present embodiment, the other end (other end side) 22 of the abdomen and crotch tightening part 20 has an inverted V-shape spreading laterally along the gluteal folds from the intersection between the left and right gluteal folds in the body center. This other end 22 is preferably sewn in a gathering and narrowing manner toward the body center, as shown in FIG. 3.

The portion of the abdomen and crotch tightening part other than the one end 21 and the other end 22 is free, without being sewn to the main body 10.

The abdomen tightening part 30 has a tightening force and is considered, for example, to be made of a highly elasticized fabric such as a power net fabric. The abdomen tightening part 30 extends from the front center of the waist part 11 of the main body 10 toward lower regions of the left and right sides while covering the wearer's abdominal region.

A central edge 31 of the abdomen tightening part 30 is sewn to the front center of the waist part 11 of the main body 10. On the other hand, left and right side edges 32 of the abdomen tightening part 30 are sewn to the sides of the main body 10 near the wearer's greater trochanters. The portion of the abdomen tightening part 30 except for the central edge 31 and the left and right side edges 32 is free, without being sewn to the main body 10. In this configuration, openings toward the side tops are formed at side upper edges 33 between the central edge 31 and the left and right side edges 32 in the abdomen tightening part 30.

In the skirt liner 1 of the present embodiment, since the portion of the abdomen and crotch tightening part 20 except for the one end 21 and the other end 22 is not sewn to the main body 10 so as to be free, the existence of the abdomen and crotch tightening part 20 does not appear on the main body 10. Furthermore, since the portion of the abdomen tightening part 30 except for the central edge 31 and the left and right side edges 32 is not sewn to the main body 10, either, so as to be free, the existence of the abdomen tightening part 30 does not appear on the main body 10, either. Therefore, the skirt liner 1 is a good-looking skirt-type undergarment and, when a woman wears an outer garment for the young such as a miniskirt or a tight skirt, the existence of the controlling undergarment does not appear on the outer garment, which would make young women feel unreluctant to wear it.

As discussed above, the skirt liner 1 of the present embodiment is the good-looking skirt-type undergarment, while achieving an excellent operational effect in controlling the shape of the abdominal and gluteal regions, as described below.

First, the abdomen and crotch tightening part 20 can control a wearer's abdominal bulge.

Furthermore, since the other end 22 of the abdomen and crotch tightening part 20 is sewn to the back lower center of the main body 10, the main back part of the main body 10 fits closely with the wearer's gluteal and femoral regions to control the sagging of the buttocks and smooth the femoral regions.

In addition, since the other end 22 of the abdomen and crotch tightening part 20 is sewn to the back lower center of the main body 10, or since it is sewn to the main back part at the position near a hem of the skirt main body 10, the hem of the skirt main body 10 can be prevented from riding up or slipping up with motions of the wearer's femoral regions.

Moreover, since the other end 22 of the abdomen and crotch tightening part 20 is sewn in the gathering and narrowing manner toward the body center, the crotch part in the abdomen and crotch tightening part 20 can be three-dimensionally shaped so as to fit tightly with the wearer's crotch region. This configuration allows the other end of the abdomen and crotch tightening part 20 to be securely forced into the hollow in the lower part of the intergluteal cleft and the body center part between the gluteal folds, whereby the main back part of the main body 10 can fit closely with the lower part of the gluteal region. As a result, the sagging of the buttocks can be better controlled.

Next, the abdomen tightening part 30 can also control the bulge of the wearer's abdomen.

Since the abdomen tightening part 30 has the shape extending obliquely downward from the front center to the left and right sides, it provides an operational effect as described below.

Figure 5:
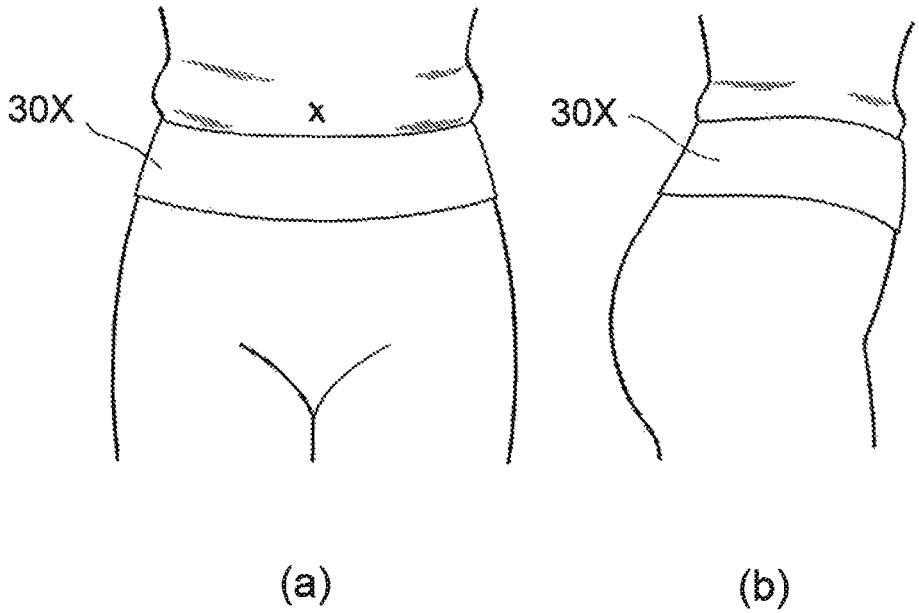
FIG. 5 is a drawing showing a conventional abdomen tightening part.
Figure 6:
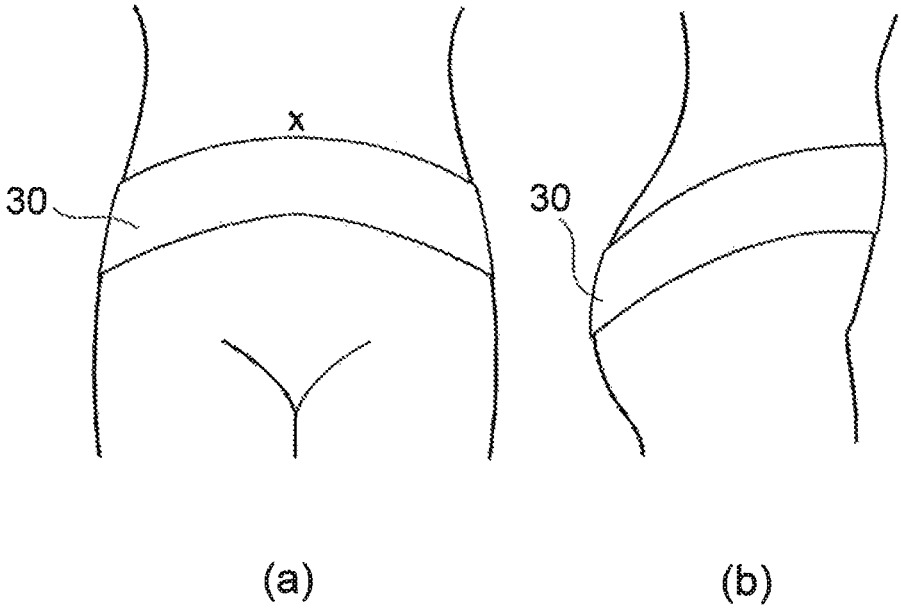
FIG. 6 is a drawing showing an abdomen tightening part in the present embodiment.

FIG. 5 is a drawing showing a conventional abdomen tightening part and FIG. 6 a drawing showing the abdomen tightening part of the present embodiment. In FIGS. 5 and 6, there are shown (a) a view from the front and (b) a view from the side.

As shown in FIG. 5, when the abdominal region is pressed by the conventional horizontally-extending abdomen tightening part 30X, the wearer's abdominal flesh is pushed up to above the abdomen tightening part 30X. As a result, there is a bump made between covered and uncovered regions.

On the other hand, as shown in FIG. 6, when the abdomen tightening part 30 of the present embodiment applies obliquely downward pressure from the front center to the left and right sides, a downward force acts on the wearer's abdominal flesh. This prevents the wearer's abdominal flesh from being pushed up to above the abdomen tightening part 30, with the result that there is no bump made between the covered and uncovered regions.

Then, the abdominal flesh moved down by the abdomen tightening part 30 is smoothed by the abdomen and crotch tightening part 20.

Since the abdomen tightening part 30 does not press the upper waist sides above the bone-projecting regions around the greater trochanters on the sides, it can prevent the abdomen side flesh from being forced out and from forming a bump between the covered and uncovered regions.

Since the side upward openings are formed at the side upper edges 33 of the abdomen tightening part 30, the abdominal flesh can be allowed to move upward on the sides, whereby the abdomen tightening part 30 can work in collaboration with the abdomen and crotch tightening part 20 to suppress the abdominal bulge while smoothing it.

Incidentally, the conventional girdles had the following problem: when a girdle is worn, the major cloth of the girdle cuts into the gluteal folds and the flesh is projected out above the waist part to form a bump between the covered and uncovered regions; as a result, it affects an outer garment.

Figure 7:
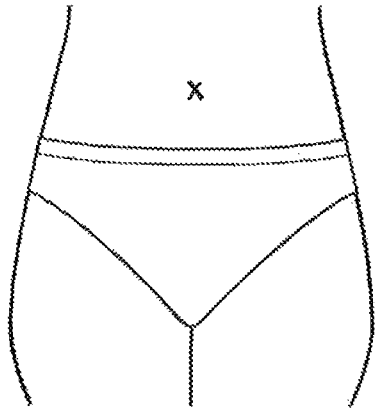
FIG. 7 is a drawing showing a woman wearing shorts without the conventional tightening part.
Figure 7:
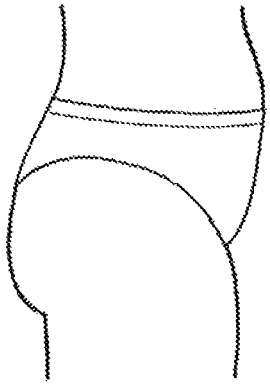
Figure 8:
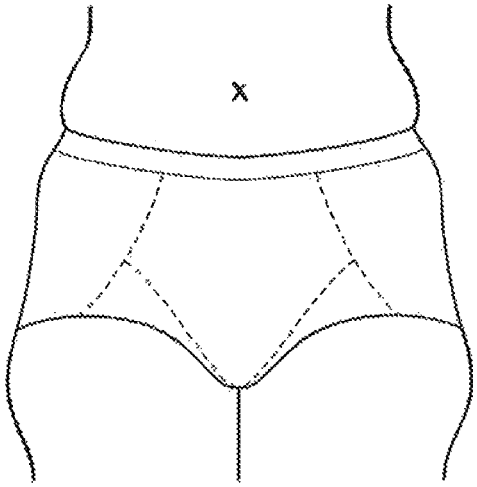
FIG. 8 is a drawing showing a woman wearing a girdle with conventional tightening parts for controlling the abdominal and gluteal regions.
Figure 8:
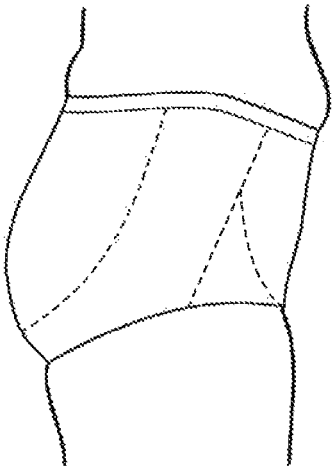
Figure 8:
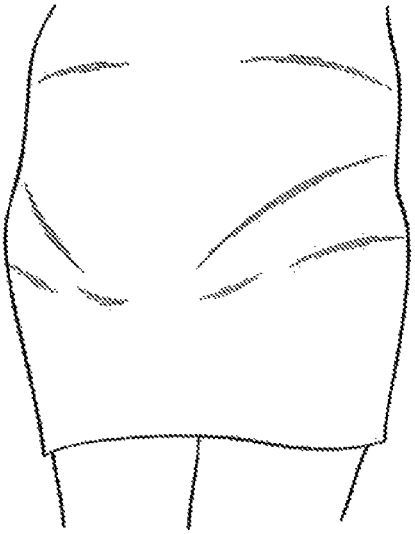
Figure 9:
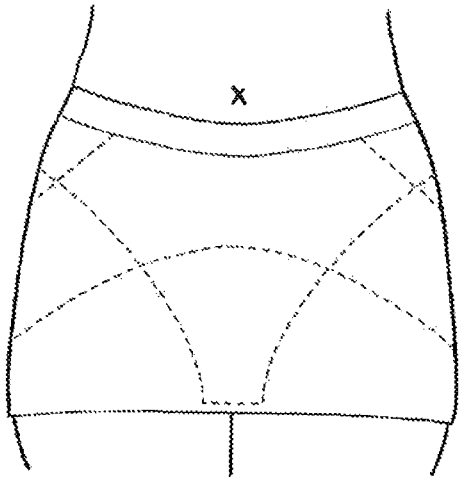
FIG. 9 is a drawing showing a woman wearing the skirt liner of the present embodiment.
Figure 9:
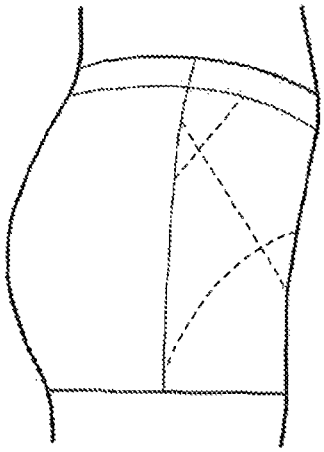
Figure 9:
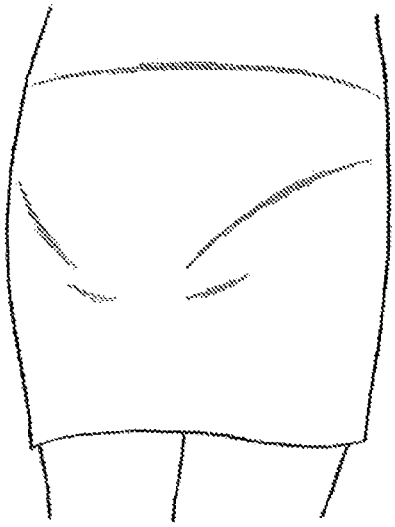

FIG. 7 is a drawing showing a state in which a woman wears shorts without the conventional tightening part, FIG. 8 a drawing showing a state in which a woman wears a girdle with the conventional tightening part for controlling the abdominal and gluteal regions, and FIG. 9 a drawing showing a state in which a woman wears the skirt liner of the present embodiment. In FIGS. 7 to 9, there are shown (a) a view from the front, (b) a view from the side, and (c) a view from the back showing a state in which the woman further wears an outer garment (e.g., a tight skirt).

As seen from FIGS. 7 and 8, the girdle can control the abdominal and gluteal regions. However, the girdle of this kind comes to form bumps between the covered and uncovered regions at the gluteal folds and at the waist part, so as to affect the outer garment.

With the skirt liner 1 of the present embodiment, however, the abdomen and crotch tightening part 20 can keep the main back part of the main body 10 fitting closely with the wearer's femoral regions so as to smooth the femoral regions, as shown in FIG. 9 and as described above. Furthermore, the abdomen tightening part 30 moves the abdominal flesh downward and the abdomen and crotch tightening part 20 smooths the moved abdominal flesh. This configuration is unlikely to form bumps at the boundaries between the covered and uncovered regions at the gluteal folds and at the waist part, and thus unlikely to affect the outer garment.

The present invention is by no means intended to be limited to the above-described embodiment, but can be modified in many ways. For example, the abdomen tightening part 30 may be sewn to the main body 10 so as to make a round along the entire edge in addition to the central edge 31 and the left and right side edges 32. This configuration can increase the controlling force on the abdominal region by the abdomen tightening part 30.

The present embodiment showed the sewing of the highly elasticized material (patch) as the abdomen tightening part 30 by way of illustration, but the abdomen tightening part 30 may be made by sticking the highly elasticized material to the main body by bonding or the like. The abdomen tightening part 30 may be formed by partially changing the elongation of a knit fabric (warp knit fabric, tubular knit fabric, or the like) during formation of the main body 10 (knitting). This method can increase the controlling force on the abdominal region by the abdomen tightening part 30 and offer a simple appearance. It can also facilitate manufacture.

The abdomen tightening part 30 may be formed, for example, by opal finish, resin printing, or special process printing. When the abdomen tightening part 30 is formed by the change of the knit fabric (warp knit fabric, tubular knit fabric, or the like), the opal finish, or the printing as described above, it can be formed integrally with the main body so that there is no distinguishable boundary.

It is also possible to adopt the following method: for example, the abdomen and crotch tightening part 20 and the main body 10 are formed as a single knit fabric in a continuous state at the one end 21 by circular knitting or by warp knitting, and after the formation, the other end 22 not joined to the main body 10 is then joined to the main body 10. In another applicable method opposite thereto, the abdomen and crotch tightening part 20 and the main body 10 are formed as a single knit fabric in a continuous state at the other end 22 and after the formation, the one end 21 not joined to the main body 10 is joined to the main body 10. In this case, the abdomen tightening part 30 may be further formed integrally with the main body 10 by partially changing the elongation of the main body 10.

Figure 10:
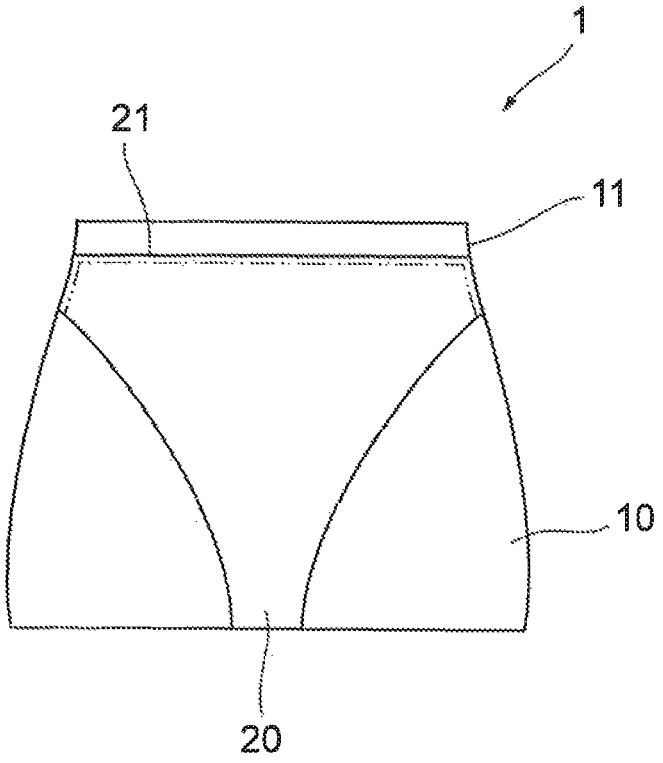
FIG. 10 is a front view of the wrong side of the skirt liner according to a first modification example of the present invention which is viewed from the front.

As shown in FIG. 10, the skirt liner 1 may be made in a form without the abdomen tightening part 30.

Figure 11:
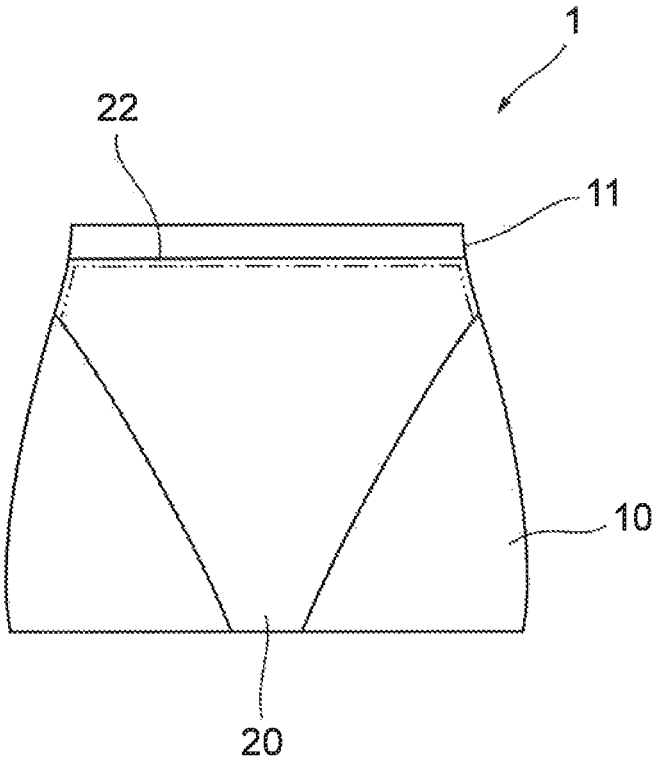
FIG. 11 is a back view of the wrong side of the skirt liner according to a second modification example of the present invention which is viewed from the back.
Figure 12:
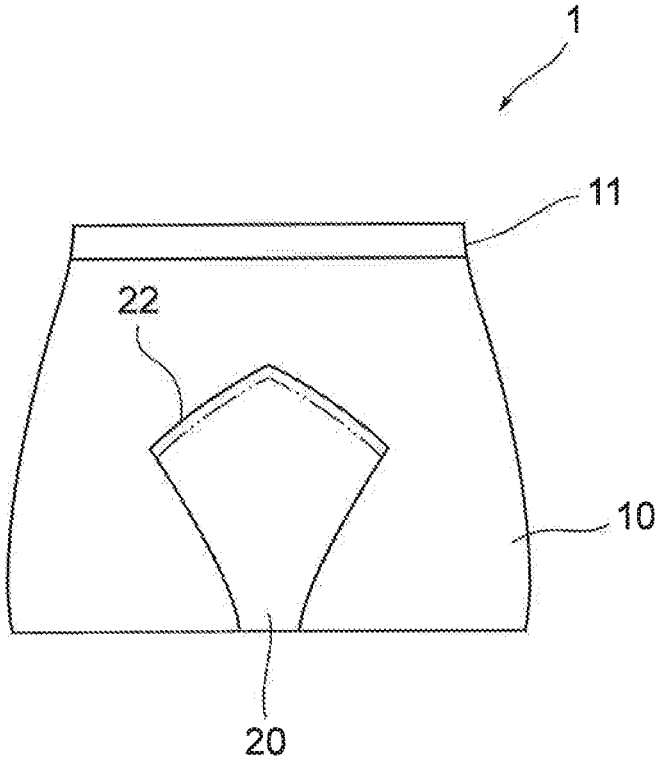
FIG. 12 is a back view of the wrong side of the skirt liner according to a third modification example of the present invention which is viewed from the back.

Furthermore, the other end side of the abdomen and crotch tightening part 20 may extend so as to further cover the wearer's gluteal region with the other end 22 being sewn to the back side of the waist part 11 of the main body 10, as shown in FIG. 11, or with the other end 22 being sewn to a halfway point on the main body 10, as shown in FIG. 12.

The shape of the other end 22 of the abdomen and crotch tightening part 20 does not have to be limited to the inverted V-shape, but may be one of various shapes such as an inverted U-shape and an arcuate shape as long as the main back part of the main body can fit closely with the gluteal region so as to control the sagging of the buttocks.

The present invention is not limited solely to the skirt liners but can also be applied to all skirt-type undergarments such as petticoats. Furthermore, the present invention does not have to be limited to the undergarments but may also be applied to all skirt-type garments.

INDUSTRIAL APPLICABILITY

The present invention is applicable to use in good-looking skirt-type controlling undergarments for young women.

REFERENCE SIGNS LIST

1 skirt liner
10 main body
11 waist part
20 abdomen and crotch tightening part

21 one end (one end side) of abdomen and crotch tightening part

22 other end (other end side) of abdomen and crotch tightening part

30 abdomen tightening part

31 central edge of abdomen tightening part

32 left and right side edges of abdomen tightening part

The invention claimed is:

1. A skirt controlling undergarment comprising:

a skirt main body having a waist part at a top portion of the skirt controlling undergarment configured to encircle a wearer's waist opposite a hem, the waist part including a front waist part, the front waist part having a center;

an abdomen and crotch tightening part which is joined at one end side thereof to a region around the front waist part of the skirt main body, which extends from the one end side adapted to cover an abdominal part and a crotch part of the wearer, and which is joined at a second end side thereof to a back side of the skirt main body; and an abdomen tightening part which extends from the center of the front waist part of the skirt main body toward left and right lower sides of the skirt main body while adaptively covering the abdominal part of the wearer, the abdomen tightening part having a central edge, a left side edge, a left side upper edge, a right side edge, and a right side upper edge;

wherein a portion of the abdomen and crotch tightening part other than the one end side and the second end side is unjoined to the skirt main body, and the second end side of the abdomen and crotch tightening part is joined to a back lower center of the back side of the skirt main body, the second end side of the abdomen and crotch tightening part becoming narrower toward the back lower center of the skirt main body such that a portion of the second end side that is joined has a width smaller than a width of the one end side joined to the front waist part creating a thong-type structure that has an inverted V-shape, an inverted U-shape, or an arcuate shape, and is adapted to be securely forced into a hollow in a lower part of a intergluteal cleft of the wearer between gluteal folds;

wherein the central edge of the abdomen tightening part is joined to the center of the front waist part of the skirt main body, wherein the left side edge and the right side edge of the abdomen tightening part are joined to right and left sides of the skirt main body, and wherein a portion of the abdomen tightening part other than the central edge, the left side edge, and the right side edge, is unjoined to the main body, and openings are formed at the left side upper edge and at the right side upper edge between the central edge and the left side edge and the right side edge.

2. The skirt controlling undergarment according to claim 1, wherein the second end side of the abdomen and crotch tightening part joined to the back lower center of the back side of the skirt main body is joined in a gathering and narrowing manner adaptively toward a body center of the wearer.

* * * * *